United States Patent [19]

Mihara et al.

[11] Patent Number: 4,596,767

[45] Date of Patent: Jun. 24, 1986

[54] SILVER HALIDE PHOTOGRAPHIC LIGHT-SENSITIVE MATERIAL

[75] Inventors: Yuji Mihara; Toshinao Ukai; Shoji Ishiguro, all of Kanagawa, Japan

[73] Assignee: Fuji Photo Film Co., Ltd., Kanagawa, Japan

[21] Appl. No.: 599,904

[22] Filed: Apr. 13, 1984

[30] Foreign Application Priority Data

Apr. 13, 1983 [JP] Japan ..... 58-65045

[51] Int. Cl.[4] ..... G03C 1/28

[52] U.S. Cl. ..... 430/576; 430/584; 430/613; 430/614

[58] Field of Search ..... 430/576, 584, 613, 614

[56] References Cited

U.S. PATENT DOCUMENTS

| | | | |
|---|---|---|---|
| 2,131,038 | 9/1938 | Brooker et al. | 430/614 |
| 2,734,900 | 2/1956 | Haseltine | 430/584 |
| 3,457,078 | 7/1969 | Riester | 430/584 |
| 3,615,632 | 10/1971 | Shiba et al. | 430/576 |
| 3,615,633 | 10/1971 | Brooks | 430/576 |
| 3,690,891 | 9/1972 | Spence et al. | 430/584 |
| 4,011,083 | 3/1977 | Durning et al. | 430/584 |

*Primary Examiner*—Mary F. Downey

*Attorney, Agent, or Firm*—Sughrue, Mion, Zinn Macpeak & Seas

[57] ABSTRACT

A silver halide photographic light-sensitive material spectrally sensitized in an infrared region is described. The silver halide photographic light-sensitive material has at least one silver halide photographic emulsion layer containing at least one infrared-sensitizing dye represented by the following general Formula (I):

wherein $R_1$, $R_2$, R, D, Z, $Z_1$, X, and n are described in the specification; and at least one compound represented by the following general Formula (II):

wherein $Z_2$, $R_6$, $R_7$ and $X_1$ are described in the specification.

The silver halide photographic light-sensitive material has improved sensitivity in an infrared spectral region and improved preservability.

12 Claims, No Drawings

SILVER HALIDE PHOTOGRAPHIC LIGHT-SENSITIVE MATERIAL

FIELD OF THE INVENTION

This invention relates to a silver halide photographic light-sensitive material spectrally sensitized in an infrared region and, more particularly, to a silver halide photographic light-sensitive material having improved sensitivity in an infrared spectral region and improved preservability.

BACKGROUND OF THE INVENTION

As one method for imagewise exposing a photographic light-sensitive material, it is known to scan an original image and expose a silver halide photographic light-sensitive material according to the image signal obtained by the scanning to thereby form a negative or positive image in conformity with the original image. This is called the scanner method.

This scanner method includes two types: one for forming images with continuous gradation; and the other for forming halftone dot images. The latter halftone dot image-forming scanner method includes a so-called dot generator method using a halftone dot generator and a so-called screened scanner method for obtaining halftone dots by using a contact screen. As a light source for recording according to these scanner methods, a glow tube, a xenon lamp, a merucry lamp, a tungsten lamp, a light-emitting diode, etc., have been employed. However, all of these light sources have the practical defect that they provide a weak output and possess a short life. As a light source for the scanner methods removing these defects, there are coherent lasers such as Ne-He laser, argon laser, He-Cd laser or the like. These light sources can provide a high output, but have the defects that they are of large size, expensive, and require use of a modulation device and that they limit safelight of light-sensitive materials due to the use of fisible light, thus having poor handling properties.

On the other hand, scanners using semiconductor lasers have the merits that the light source is of small size, inexpensive, permits modulation with ease, and possesses a longer life then the above-described lasers, and that, since the semiconductór emits infrared rays, light-sensitive materials with sensitivity in an infrared region permits use of a bright safe light. Thus, such scanners provide improved handling properties of light-sensitive materials. However, the above-described excellent properties of semiconductor lasers have not been utilized due to the absence of light-sensitive materials having high sensitivity in an infrared region and having excellent preservability.

As commercially available light-sensitive materials with sensitivity in an infrared region, there is, for example, HIE135-20 made by Eastman Kodak Co. However, it is well known that these light-sensitive materials are unstable in sensitivity and require special caution for preservation thereof. For example, a catalogue of HIE135-20 indicates that the light-sensitive material should be stored in a freezer or refrigerator.

As one technique in producing photographic light-sensitive materials, an optically sensitizing technique is known which involves adding a certain kind of cyanine dye to a silver halide photographic emulsion to thereby expand the light-sensitive wavelength region of the light-sensitive material to a longer wavelength side.

This technique is known to be applicable not only to a visible region but to an infrared region as well. For optical sensitization in an infrared region, sensitizing dyes which absorb infrared light are used. Examples thereof are described in, for example, Mees, *The Theory of the Photographic Process,* 3rd Ed. (Macmillan, 1966), pp. 198–201. With the abovedescribed infrared-sensitive materials, optical sensitivity, or sensitivity to infrared light, is desirably high, and less change in sensitivity during storage occur. For this purpose, many sensitizing dyes have so far been developed.

Examples of such dyes are described in, for example, U.S. Pat. Nos. 2,095,854, 2,095,856, 2,955,939, 3,482,978, 3,552,974, 3,573,921, 3,582,344, etc. However, those sensitizing dyes which are described in these patents do not provide enough sensitivity and preservability.

On the other hand, addition of a second specifically selected organic compound to a light-sensitive material in addition to the optically sensitizing dye sometimes remarkably raises the optical sensitivity. This is known as a supersensitizing effect. In general, addition of a second organic compound or an inorganic substance does not increase, but rather decreases, sensitivity. Therefore, the supersensitization can be said to be a specific phenomenon, and selection of the sensitizing dye and the second organic compound or inorganic substance to be combined with each other is remarkably restricted. Thus, an apparently slight difference in chemical structure can lead to such a great influence on the supersensitization effect that the supersensitizing combination is not predictable from chemical structure alone.

As the second organic compounds for supersensitization which are conventionally known, there are illustrated, for example, triazine derivatives described in U.S. Pat. Nos. 2,875,058 and 3,695,888, mercapto compounds described in U.S. Pat. No. 3,457,078, thiourea compounds described in U.S. Pat. No. 3,458,318, and pyrimidine derivatives described in U.S. Pat. No. 3,615,632. U.S. Pat. No. 4,011,083 describes effecting infrared sensitization using an azaindene compound and a desensitizing amount of an infrared-sensitizing dye.

However, the techniques described in these patents are still insufficient, though they truly increase infrared sensitivity and some of them provide somewhat improved preservability. Thus, a supersensitizing technique providing improved infrared sensitivity and improved preservability has been desired.

On the other hand, an emulsion in a solution state before being coated is generally liable to undergo change in sensitivity and fogging due to, particularly, removal, deposition or decomposition of the sensitizing dye. Such changes in photographic properties of an emulsion before coating is a critical problem in the production of light-sensitive materials. However, conventionally known stabilizers such as 1-phenyl-5-mercaptotetrazole are not effective for improving stability of an infrared-sensitizing dye-containing emulsion having been solated for coating. Therefore, a need exists to develop a technique which specifically improves solution stability with time of an infrared sensitizing dye-containing emulsion.

SUMMARY OF THE INVENTION

An object of the present invention is to provide a silver halide photographic light-sensitive material having high sensitivity to infrared rays.

Another object of the present invention is to provide a silver halide photographic emulsion which undergoes less change in sensitivity in a solution state before being coated and which has high sensitivity to infrared rays.

A further object of the present invention is to provide a silver halide light-sensitive material which undergoes less change in sensitivity and less formation of fog during storage and which has high sensitivity to infrared rays.

The above-described objects have successfully been attained by incorporating, in a silver halide photographic light-sensitive emulsion, at least one infrared-sensitizing dye represented by the following general formula (I) and at least one compound represented by the following general formula (II):

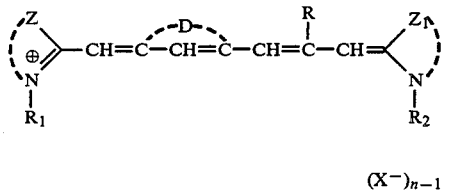

(I)

wherein $R_1$ and $R_2$, which may be the same or different, each represents an alkyl group or a substituted alkyl group, R represents a hydrogen atom, a lower alkyl group, a phenyl group or a benzyl group, D represents non-metallic atoms necessary for forming a 6-membered ring containing three methylene units (this ring optionally having a substituent or substituents), Z and $Z_1$ each represents non-metallic atoms necessary for completing a 5- or 6-membered, nitrogen-containing heterocyclic ring, X represents an acid anion, and n represents 1 or 2; and

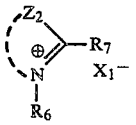

(II)

wherein $Z_2$ represents non-metallic atoms necessary for completing a 5- or 6-membered, nitrogen-containing heterocyclic ring, $R_6$ represents a hydrogen atom, an alkyl group or an alkenyl group, $R_7$ represents a hydrogen atom or a lower alkyl group, and $X_1$ represents an acid anion.

DETAILED DESCRIPTION OF THE INVENTION

The compounds of the present invention represented by the general formula (II) are additives known in the photographic field as stabilizers having the effect of preventing deterioration of latent image, but have never been used as second organic compounds for attaining supersensitization. According to the discovery of the inventors, these compounds specifically show supersensitizing effect when combined with infrared-sensitizing dyes, but do not show the effect when combined with other visible region-sensitizing dyes.

Accordingly, the supersensitization effect obtained by combining the compounds of the general formula (II) with the infrared-sensitizing dyes of the general formula (I) is a surprising effect which cannot be expected from conventional knowledge.

The compounds of the general formulae (I) and (II) to be used in the present invention are described in detail below.

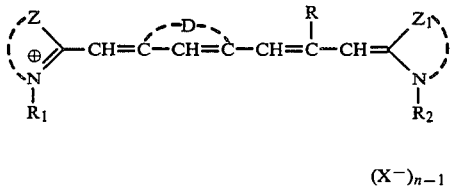

(I)

$R_1$ and $R_2$, which may be the same or different, each represents an alkyl group (preferably containing 1 to 8 carbon atoms, e.g., a methyl group, an ethyl group, a propyl group, a butyl group, a pentyl group, a heptyl group, etc.) or a substituted alkyl group preferably containing 6 or less carbon atoms (substituted by, for example, a carboxy group, a sulfo group, a cyano group, a halogen atom (e.g., a fluorine atom, a chlorine atom, a bromine atom, etc.), a hydroxy group, an alkoxycarbonyl group (containing 8 or less carbon atoms, e.g., a methoxycarbonyl group, an ethoxycarbonyl group, a benzyloxycarbonyl group, etc.), an alkoxy group (containing 7 or less carbon atoms, e.g., a methoxy group, an ethoxy group, a propoxy group, a butoxy group, a benzyloxy group, etc.), an aryloxy group (e.g., a phenoxy group, a p-tolyloxy group, etc.), an acyloxy group (containing 3 or less carbon atoms, e.g., an acetyloxy group, a propionyloxy group, etc.), an acyl group (containing 8 or less carbon atoms, e.g., an acetyl group, a propionyl group, a benzoyl group, a mesyl group, etc.), a carbamoyl group (e.g., a carbamoyl group, an N,N-dimethylcarbamoyl group, a morpholinocarbamoyl group, a piperidinocarbamoyl group, etc.), a sulfamoyl group (e.g., a sulfamoyl group, an N,N-dimethylsulfamoyl group, a morpholinosulfonyl group, etc.), an aryl group (e.g., a phenyl group, a p-hydroxyphenyl group, a p-carboxyphenyl group, a p-sulfophenyl group, an α-naphthyl group, etc.), or the like, provided that the alkyl group may be substituted by two or more of these substituents).

R represents a hydrogen atom, a lower alkyl group containing 4 or less carbon atoms (e.g., a methyl group, an ethyl group, a propyl group, etc.), a phenyl group or a benzyl group.

D represents non-metallic atoms necessary for completing a 6-membered ring containing three methylene units, which ring may be substituted by a lower alkyl group containing 4 or less carbon atoms (e.g., a methyl group) or the like.

The following formula is a preferred example of the 6-membered ring formed with D and the three methylene units:

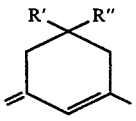

In the above formula, R′ and R″ each represents a hydrogen atom, a lower alkyl group containing 4 or less carbon atoms or a phenyl group.

Z and $Z_1$ each represents non-metallic atoms necessary for completing a 5- or 6-membered, nitrogen-containing heterocyclic ring such as a thiazole nucleus (for example, benzothiazole, 4-chlorobenzothiazole, 5-chlorobenzothiazole, 6-chlorobenzothiazole, 7-chlorobenzothiazole, 4-methylbenzothiazole, 5-methylbenzothiazole, 6-methylbenzothiazole, 5-bromobenzothiazole, 6-bromobenzothiazole, 5-iodobenzothiazole, 5-phenylbenzothiazole, 5-methoxybenzothiazole, 6-methoxybenzothiazole, 5-ethoxybenzothiazole, 5-carboxybenzothiazole, 5-ethoxycarbonylbenzothiazole, 5-phenethylbenzothiazole, 5-fluorobenzothiazole, 5-trifluoromethylbenzothiazole, 5,6-dimethylbenzothiazole, 5-hydroxy-6-methylbenzothiazole, tetrahydrobenzothiazole, 4-phenylbenzothiazole, naphtho[2,1-d]thiazole, naphtho[1,2-d]thiazole, naphtho[2,3-d]thiazole, 5-methoxynaphtho[1,2-d]thiazole, 7-ethoxynaphtho[2,1-d]thiazole, 8-methoxynaphtho[2,1-d]thiazole, 5-methoxynaphtho[2,3-d]thiazole, etc.), a selenazole nucleus (for example, benzoselenazole, 5-chlorobenzoselenazole, 5-methoxybenzoselenazole, 5-methylbenzoselenazole, 5-hydroxybenzoselenazole, naphtho[2,1-d]selenazole, naphtho[1,2-d]selenazole, etc.), an oxazole nucleus (for example, benzoxazole, 5-chlorobenzoxazole, 5-methylbenzoxazole, 5-bromobenzoxazole, 5-fluorobenzoxazole, 5-phenylbenzoxazole, 5-methoxybenzoxazole, 5-trifluorobenzoxazole, 5-hydroxybenzoxazole, 5-carboxybenzoxazole, 6-methylbenzoxazole, 6-chlorobenzoxazole, 6-methoxybenzoxazole, 6-hydroxybenzoxazole, 5,6-dimethylbenzoxazole, 4,6-dimethylbenzoxazole, 5-ethoxybenzoxazole, naphtho[2,1-d]oxazole, naphtho[1,2-d]oxazole, naphtho[2,3-d]oxazole, etc.), a quinoline nucleus (for example, 2-quinoline, 3-methyl-2-quinoline, 5-ethyl-2-quinoline, 6-methyl-2-quinoline, 8-fluoro-2-quinoline, 6-methoxy-2-quinoline, 6-hydroxy-2-quinoline, 8-chloro-2-quinoline, 8-fluoro-4-quinoline, etc.), a 3,3-dialkylindolenine nucleus (for example, 3,3-dimethylindolenine, 3,3-diethylindolenine, 3,3-dimethyl-5-cyanoindolenine, 3,3-dimethyl-5-methoxyindolenine, 3,3-dimethyl-5-methylindolenine, 3,3-dimethyl-5-chloroindolenine, etc.), an imidazole nucleus (for example, 1-methylbenzimidazole, 1-ethylbenzimidazole, 1-methyl-5-chlorobenzimidazole, 1-ethyl-5-chlorobenzimidazole, 1-methyl-5,6-dichlorobenzimidazole, 1-ethyl-5,6-dichlorobenzimidazole, 1-alkyl-5-methoxybenzimidazole, 1-methyl-5-cyanobenzimidazole, 1-ethyl-5-cyanobenzimidazole, 1-methyl-5-fluorobenzimidazole, 1-ethyl-5-fluorobenzimidazole, 1-phenyl-5,6-dichlorobenzimidazole, 1-allyl-5,6-dichlorobenzimidazole, 1-allyl-5-chlorobenzimidazole, 1-phenylbenzimidazole, 1-phenyl-5-chlorobenzimidazole, 1-methyl-5-trifluoromethylbenzimidazole, 1-ethyl-5-trifluoromethylbenzimidazole, 1-ethylnaphtho[1,2-d]imidazole, etc.), a pyridine nucleus (for example, pyridine, 5-methyl-2-pyridine, 3-methyl-4-pyridine, etc.), etc. Of these, a thiazole nucleus and an oxazole nucleus are advantageously used, with a benzothiazole nucleus, a naphthothiazole nucleus, a naphthoxazole nucleus and a benzoxazole nucleus being more preferably used.

X represents an acid anion, for example, a halide ion (e.g., $Cl^-$, $Br^-$ or $I^-$), perchlorate ion, thiocyanate ion, acetate ion, methylsulfate ion, ethylsulfate ion, benzenesulfonate ion, toluenesulfonate ion, etc.

n represents 1 or 2 and, where the general formula (I) represents a betaine compound, n is 1.

Sensitizing dyes represented by the general formula (I) are well known compounds and can be synthesized by the method described in U.S. Pat. No. 2,734,900.

Sensitizing dyes represented by the general formula (I) render an emulsion sensitive to light rays of the infrared region (700 nm or longer, particularly 740 nm or longer, in wavelength). Specific examples of the sensitizing dyes represented by the general formula (I) are illustrated below which, however, do not limit the sensitizing dyes to be used in the present invention in any way.

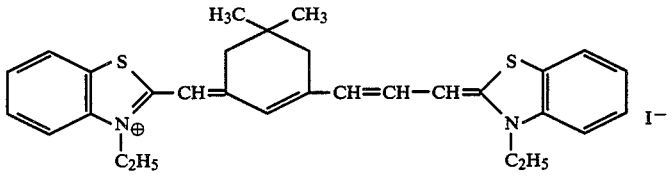

(I-1)

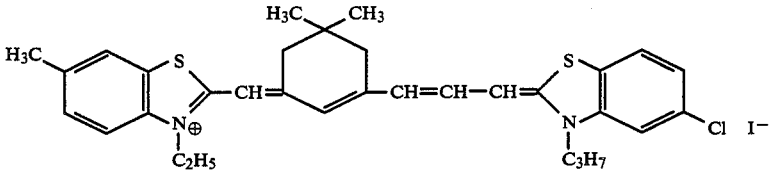

(I-2)

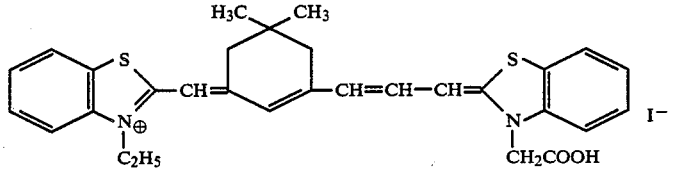

(I-3)

-continued
(I-4)
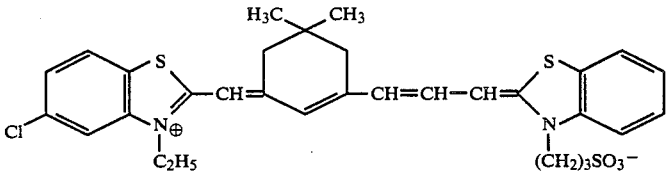
(I-5)
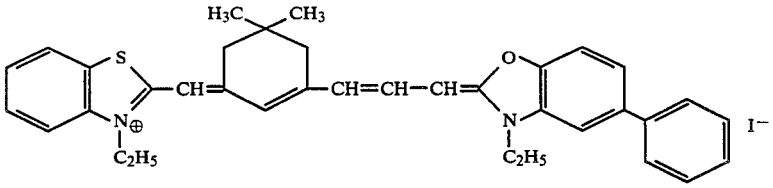
(I-6)
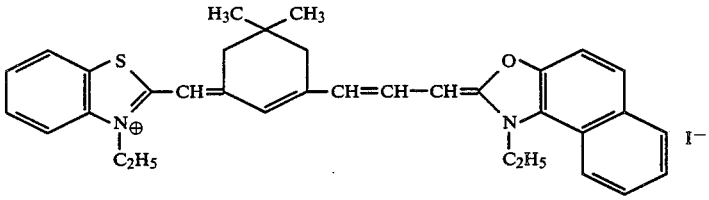
(I-7)
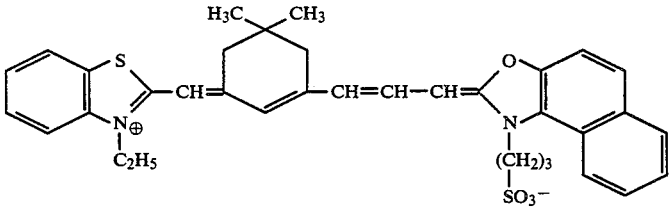
(I-8)
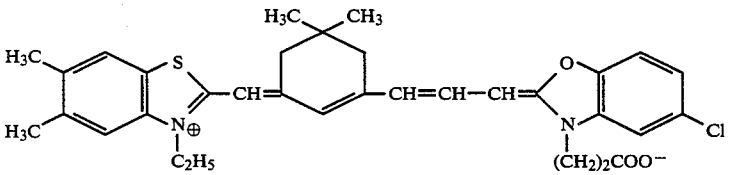
(I-9)
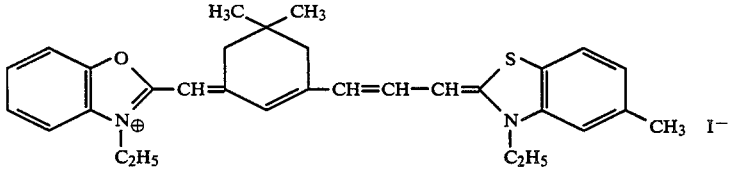
(I-10)
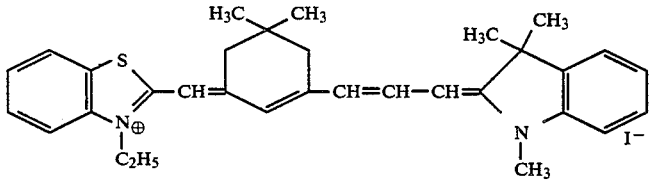
(I-11)
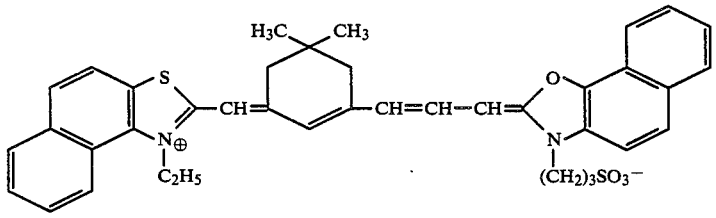

-continued (I-12)

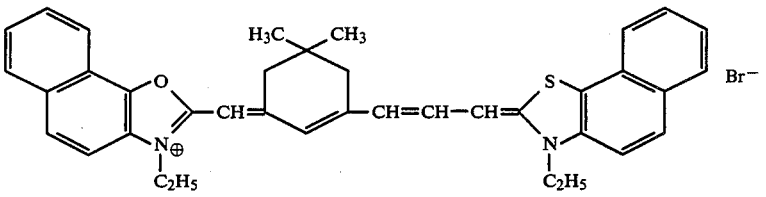

In the general formula (II):

(II)

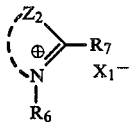

$Z_2$ represents non-metallic atoms necessary for completing a 5- or 6-membered nitrogen-containing heterocyclic ring which may optionally be fused with a benzene or naphthlene ring, examples thereof including thiazoliums (for example, thiazolium, 4-methylthiazolium, benzothiazolium, 5-methylbenzothiazolium, 5-chlorobenzothiazolium, 5-methoxybenzothiazolium, 6-methylbenzothiazolium, 6-methoxybenzothiazolium, naphtho[1,2-d]thiazolium, naphtho[2,1-d]thiazolium, etc.), oxazoliums (for example, oxazolium, 4-methyloxazolium, benzoxazolium, 5-chlorobenzoxazolium, 5-phenylbenzoxazolium, 5-methylbenzoxazolium, naphtho[1,2-d]oxazolium, etc.), imidazoliums (for example, 1-methylbenzimidazolium, 1-propyl-5-chlorobenzimidazolium, 1-ethyl-5,6-dichlorobenzimidazolium, 1-allyl-5-trifluoromethyl-6-chlorobenzimidazolium, etc.), selenazoliums (for example, benzoselenazolium, 5-chlorobenzoselenazolium, 5-methylbenzoselenazolium, 5-methoxybenzoselenazolium, naphtho[1,2-d]selenazolium, etc.), etc. Preferable examples of $Z_2$ are thiazoliums, with substituted or unsubstituted benzothiazoliums, or naphthothiazoliums being more advantageously used.

$R_6$ represents a hydrogen atom, an alkyl group (containing, preferably, 8 or less carbon atoms, e.g., a methyl group, an ethyl group, a propyl group, a butyl group, a pentyl group, etc.) or an alkenyl group (e.g., an allyl group).

$R_7$ represents a hydrogen atom or a lower alkyl group containing 4 or less carbon atoms (e.g., a methyl group, an ethyl group, etc.).

X represents an acid anion, for example, a halide ion (e.g., $Cl^-$, $Br^-$ or $I^-$), perchlorate ion, thiocyanate ion, acetate ion, methylsulfate ion, ethylsulfate ion, benzenesulfonate ion, toluenesulfonate ion, etc.

Sensitizing dyes represented by the general formula (II) are well known compounds and can be easily synthesized by reference to the disclosure of U.S. Pat. Nos. 2,131,038, 2,704,721 and 3,265,498.

Specific examples of the compounds represented by the general formula (II) are illustrated below which, however, are not to be construed as limiting the compounds of the present invention in any way.

(II-1)

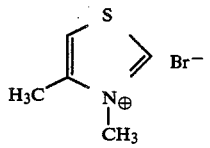

(II-2)

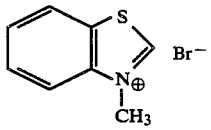

(II-3)

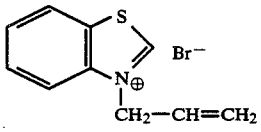

(II-4)

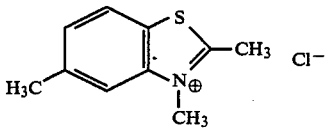

(II-5)

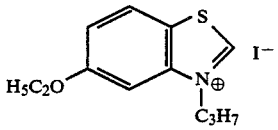

(II-6)

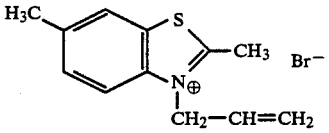

(II-7)

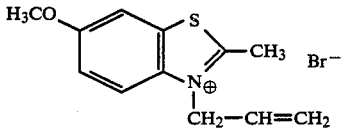

(II-8)

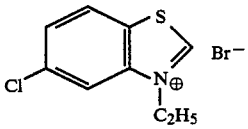

(II-9)

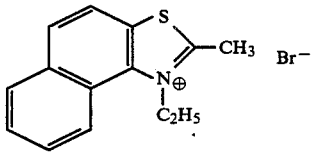

-continued (II-10)

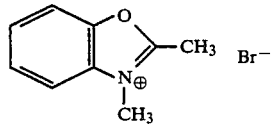

(II-11)

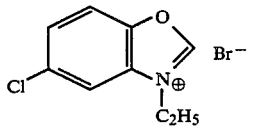

(II-12)

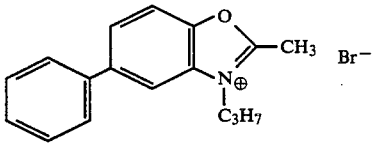

(II-13)

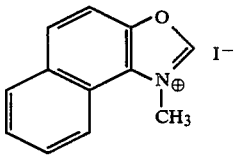

(II-14)

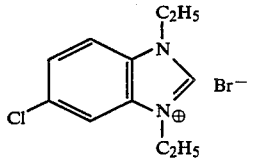

(II-15)

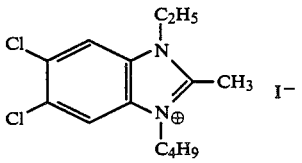

(II-16)

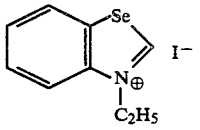

(II-17)

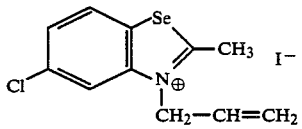

(II-18)

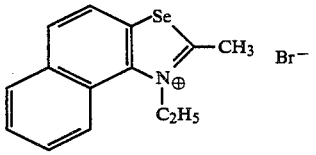

Of these spcific examples, (II-1) to (II-9) are preferable.

The infrared-sensitizing dye of the present invention is incorporated in a silver halide photographic emulsion in a content of $5\times10^{-7}$ mol to $5\times10^{-3}$ mol, preferably $1\times10^{-6}$ mol to $1\times10^{-3}$ mol, more preferably $2\times10^{-6}$ mol to $5\times10^{-4}$ mol, per mol of silver halide.

The infrared-sensitizing dyes to be used in the present invention can be directly dispersed in an emulsion. Alternatively, they may be first dissolved in a suitable solvent such as methyl alcohol, ethyl alcohol, methyl cellosolve, acetone, water, pyridine, or a mixture thereof to add them to an emulsion as a solution. Ultrasonic wave can be applied to the dissolving step. As a process for adding the infrared-sensitizing dye to an emulsion, there is employed a process of dissolving the dye in a volatile organic solvent, dispersing the resulting solution in a hydrophilic colloid, and adding this dispersion to an emulsion as described in U.S. Pat. No. 3,469,987; a process of dispersing a water-insoluble dye in an aqueous solution without dissolution, and adding the resulting dispersion to an emulsion as described in U.S. Pat. No. 3,676,147 (corresponding to Japanese Patent Publication No. 24185/71); a process of dissolving the dye in a surfactant and adding the resulting solution to an emulsion as described in U.S. Pat. No. 3,822,135; a process of dissolving the dye using a compound capable of effecting a red shift, and adding the resulting solution to an emulsion as described in U.S. Pat. No. 4,199,360 (corresponding to Japanese Patent Application (OPI) No. 74624/76 (the term "OPI" as used herein refers to a "published unexamined Japanese patent application"); or a process of dissolving the dye in a substantially water-free acid, and adding the resulting solution to an emulsions as described in Japanese Patent Application (OPI) No. 80826/75. In addition, those processes which are described in U.S. Pat. Nos. 2,912,343, 3,342,605, 2,996,287, 3,429,835, etc., can be employed for adding the dye to an emulsion. The aforesaid infrared-sensitizing dyes may be uniformly dispersed in a silver halide emulsion prior to coating on a suitable support. Of course, this dispersing procedure may be conducted in any step of preparing the silver halide emulsion.

The compound of the present invention represented by the general formula (II) is advantageously used in an amount of about 0.01 g to about 5 g per mol of silver halide in an emulsion.

The ratio (by weight) of the amount of the infrared-sensitizing dye of the general formula (I) to that of the compound represented by the general formula (II) is advantageously 1/1 to 1/300, particularly advantageously ½ to 1/50.

The compound of the present invention represented by the general formula (II) can be directly dispersed in an emulsion, or may be dissolved in a suitable solvent (e.g., water, methyl alcohol, ethyl alcohol, propanol, methyl cellosolve, acetone, etc.) or in a mixture of these solvents and added as a solution to an emulsion. In addition, the compound of the general formula (II) can be added to an emulsion as a solution or as a colloid dispersion according to the aforesaid processes for adding sensitizing dyes.

The compound represented by the general formula (II) may be added to an emulsion before or after the addition of the sensitizing dye represented by the general formula (I). Also, the compound of the general formula (II) and the sensitizing dye of the general formula (I) may be separately dissolved, and the resulting solutions may be simultaneously added to an emulsion as separate solutions or may be mixed and added to an emulsion as a mixture solution.

The combination of the sensitizing dye represented by the general formula (I) and the compound represented by the general formula (II) is advantageously further combined with a compound represented by the following general formula (III):

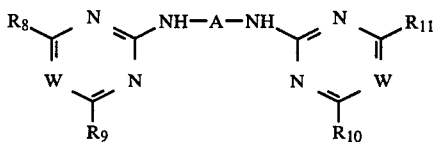

(III)

wherein A represents a divalent aromatic residue, $R_8$, $R_9$, $R_{10}$ and $R_{11}$ each represents a hydrogen atom, a hydroxy group, an alkyl group, an alkoxy group, an aryloxy group, a halogen atom, a heterocyclic ring nucleus, a heterocyclylthio group, an arylthio group, an amino group, a substituted or unsubstituted alkylamino group, a substituted or unsubstituted arylamino group, a substituted or unsubstituted aralkylamino group, an aryl group, or a mercapto group, provided that at least one of A, $R_8$, $R_9$, $R_{10}$ and $R_{11}$ possesses a sulfo group, and W represents —CH= or —N=.

More particularly, in the general formula (III), —A— represents a divalent aromatic residue which may have a group of $SO_3M$ (wherein M represents a hydrogen atom or a cation capable of imparting water solubility (e.g., sodium or potassium)).

Useful examples of —A— include, for example, —$A_1$— and —$A_2$— illustrated below, provided that, where $R_8$, $R_9$, $R_{10}$ and $R_{11}$ do not have —$SO_3M$, —A— is selected from —$A_1$—.

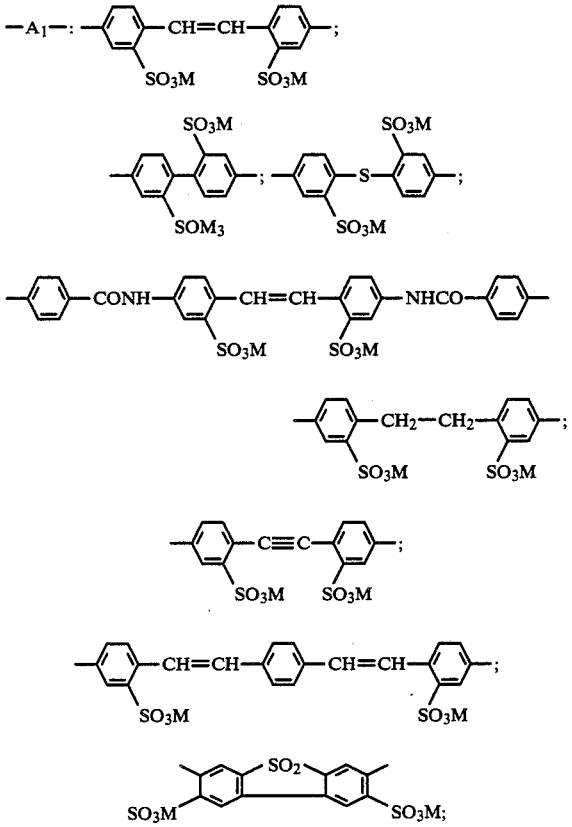

-continued

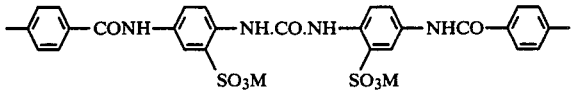

etc.

(wherein M represents a hydrogen atom or a cation capable of imparting water solubility).

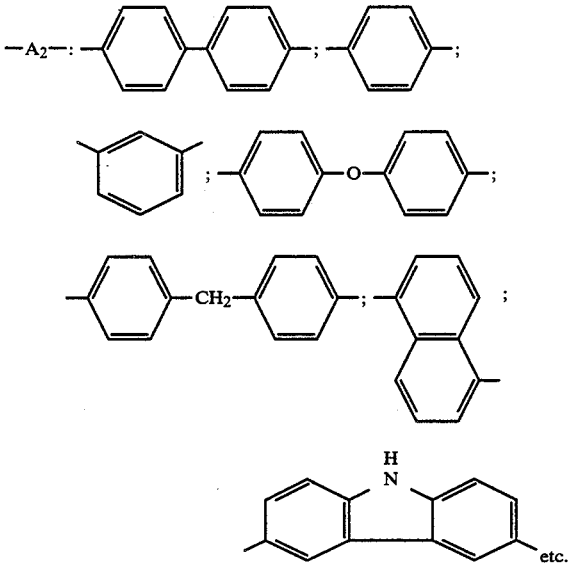

$R_8$, $R_9$, $R_{10}$ and $R_{11}$ each represents a hydrogen atom, a hydroxy group, a lower alkyl group (containing, preferably, 1 to 4 carbon atoms, e.g., a methyl group, an ethyl group, an n-propyl group, an n-butyl group, etc.), an alkoxy group (containing, preferably, 1 to 8 carbon atoms, e.g., a methoxy group, an ethoxy group, a propoxy group, a butoxy group, etc.), an aryloxy group (e.g., a phenoxy group, a naphthoxy group, an o-toluoxy group, a p-sulfophenoxy group, etc.), a halogen atom (e.g., a chlorine atom, a bromine atom, etc.), a heterocyclic ring nucleus (e.g., a morpholinyl group, a piperidyl group, etc.), an alkylthio group (e.g., a methylthio group, an ethylthio group, etc.), a heterocyclylthio group (e.g., a benzothiazolylthio group, a benzimidazolylthio group, a phenyltetrazolylthio group, etc.), an arylthio group (e.g., a phenylthio group, a tolylthio group, etc.), an amino group, an alkylamino group, a substituted amino group (e.g., a methylamino group, an ethylamino group, a propylamino group, a dimethylamino group, a diethylamino group, a dodecylamino group, a cyclohexylamino group, a β-hydroxyethylamino group, a di(β-hydroxyethyl)amino group, a β-sulfoethylamino group, etc.), an arylamino group, a substituted arylamino group (e.g., an anilino group, an o-sulfoanilino group, an m-sulfoanilino group, a p-sulfoanilino group, an o-toluidino group, an m-toluidino group, a p-toluidino group, an o-carboxyanilino group, an m-carboxyanilino group, a p-carboxyanilino group, an o-chloroanilino group, an m-chloroanilino group, a p-chloroanilino group, a p-aminoanilino group, an o-anisidino group, an m-anisidino group, a p-anisidino group, an o-acetaminoanilino group, a hydroxyanilino group, a disulfophenylamino group, a naphthylamino group, a sulfonaphthylamino group, etc.), a heterocyclylamino group (e.g., a 2-benzothiazolylamino group, a 2-pyridylamino group, etc.), a substituted or unsubstituted aralkylamino group (e.g., a benzylamino group, an o-anisylamino group, an m-anisylamino group, a p-anisylamino group, etc.), an aryl group (e.g., a phenyl group, etc.), or a mercapto group.

$R_8$, $R_9$, $R_{10}$ and $R_{11}$ may be the same as or different from each other. Where —A— is selected from among group —$A_2$—, at least one of $R_8$, $R_9$, $R_{10}$ and $R_{11}$ must have one or more sulfo groups (in either free acid form or salt form).

W represents —CH= or —N=, with —CH= being preferably used.

Specific examples of the compounds of the present invention represented by the general formula (III) are illustrated below which, however, are not to be construed as limiting the compounds of the present invention in any way.

(III-1) Disodium 4,4'-bis[4,6-di(benzothiazolyl-2-thio)-pyrimidin-2-ylamino]stilbene-2,2'-disulfonate (III-2) Disodium 4,4'-bis[4,6-di(benzothiazolyl-2-amino)pyrimidin-2-ylamino]stilbene-2,2'-disulfonate (III-3) Disodium 4,4'-bis[4,6-di(naphthyl-2-oxy)pyrimidin-2-ylamino]stilbene-2,2'-disulfonate (III-4) Disodium 4,4'-bis[4,6-di(naphthyl-2-oxy)pyrimidin-2-ylamino]bibenzyl-2,2'-disulfonate (III-5) Disodium 4,4'-bis(4,6-dianilinopyrimidin-2-ylamino)stilbene-2,2'-disulfonate (III-6) Disodium 4,4'-bis[4-chloro-6-(2-naphthyloxy)-pyrimidin-2-ylamino]biphenyl-2,2'-disulfonate (III-7) Disodium 4,4'-bis[4,6-di(1-phenyltetrazolyl-5-thio)pyrimidin-2-ylamino]stilbene-2,2'-disulfonate (III-8) Disodium 4,4'-bis[4,6-di(benzimidazolyl-2-thio)-pyrimidin-2-ylamino]stilbene-2,2'-disulfonate (III-9) Disodium 4,4'-bis(4,6-diphenoxypyrimidin-2-ylamino)stilbene-2,2'-disulfonate (III-10) Disodium 4,4'-bis(4,6-diphenylthiopyrimidin-2-ylamino)stilbene-2,2'-disulfonate (III-11) Disodium 4,4'-bis(4,6-dimercaptopyrimidin-2-ylamino)biphenyl-2,2'-disulfonate (III-12) Disodium 4,4'-bis(4,6-dianilino-triazin-2-ylamino)stilbene-2,2'-disulfonate (III-13) Disodium 4,4'-bis(4-anilino-6-hydroxy-triazin-2-ylamino)stilbene-2,2'-disulfonate (III-14) Disodium 4,4'-bis(4-naphthylamino-6-anilino-triazin-2-ylamino)stilbene-2,2'-disulfonate Of these specific examples, (III-1) to (III-12) are preferable, with (III-1), (III-2), (III-3), (III-4), (III-5) and (III-7) being particularly preferable.

The compounds of the present invention represented by the general formula (III) are advantageously used in amounts of about 0.01 g to about 5 g per mol of silver halide in an emulsion.

The ratio (by weight) of the infrared-sensitizing dye represented by the general formula (I) to the compound represented by the general formula (III) is advantageously in the range of from 1/1 to 1/100, particularly advantageously from ½ to 1/50.

The compound represented by the general formula (III) to be used in the present invention may be directly dispersed in an emulsion or may be dissolved in a suitable solvent (for example, methyl alcohol, ethyl alcohol, methyl cellosolve, water, etc.) or a mixture thereof and added as a solution to an emulsion.

Also, the compound of the general formula (III) may be added to an emulsion as a solution or a colloid dispersion prepared according to known manners employed for adding the sensitizing dye.

Further, the compound may be added to an emulsion in a manner described in Japanese Patent Application (OPI) No. 80119/75.

The sensitizing dye of the present invention may be used in combination with other sensitizing dye or dyes. For example, those sensitizing dyes which are described in U.S. Pat. Nos. 3,703,377, 2,688,545, 3,397,060, 3,615,635, 3,628,964, British Pat. Nos. 1,242,588, 1,293,862, Japanese Patent Publication Nos. 4936/68, 14030/69, 10773/68, U.S. Pat. No. 3,416,927, Japanese Patent Publication No. 4930/68, U.S. Pat. Nos. 3,615,613, 3,615,632, 3,617,295, 3,635,721, etc., can be used.

As the silver halide to be used in the present invention, any of silver chloride, silver bromide, silver iodide, silver chlorobromide, silver chloroiodide, silver bromoiodide, silver chlorobromoiodide, etc., may be employed. Of these, silver chlorobromoiodide, silver chlorobromide, and silver bromoiodide are preferable in the present invention. More preferably, silver chlorobromide or silver chlorobromoiodide containing 2 mol% or less of silver iodide are advantageously used.

These silver halide grains may be coarse grains, fine grains or the mixture thereof, and are prepared according to known processes, for example, a single jet process, a double jet process, or a controlled double jet process.

The silver halide grains may have a uniform crystal structure or a layered structure in which the inner portion and the outer portion have different properties, or may be of a so-called conversion type as described in British Pat. No. 635,841 and U.S. Pat. No. 3,622,318. In addition, they may be of the type forming a latent image mainly on the surface thereof or of the type forming a latent image within the grains. These photographic emulsions can be prepared by generally employed various processes such as an ammoniacal process, a neutral process, and an acidic process, which are also described in such books as Mees, *The Theory of the Photographic Process* (Macmillan), Glafkides, *Photographic Chemistry* (Fountain Press), etc., and *Research Disclosure,* Vol. 176 (December, 1978), RD-17643.

The silver halide emulsion of the present invention preferably has a monodisperse particle size distribution.

Mean diameter of silver halide grains (measured by, for example, a projected area method in terms of number average value) preferably ranges from about 0.04 to about 4$\mu$, with 0.7$\mu$ or less being particularly preferable.

In the step of forming silver halide grains, a silver halide solvent may be used for controlling the growth of the grains. Examples of the silver halide solvent include ammonia, potassium rhodanide, ammonium rhodanide, thioether compounds (e.g., those described in U.S. Pat. Nos. 3,271,157, 3,574,628, 3,704,130, 4,297,439, 4,276,374, etc.), thione compounds (e.g., those described in Japanese Patent Application (OPI) Nos. 144319/78, 82408/78, 77737/80, etc.), amine compounds (e.g., those described in Japanese Patent Application (OPI) No. 100717/79), etc.

In addition, a water-soluble rhodium salt and/or water-soluble iridium salt may be added upon, before or after formation of silver halide grains for the purpose of improving reciprocity law failure properties in short time exposure with high illumination, etc.

To the silver halide photographic emulsion is applied a usually employed chemical sensitization such as gold sensitization (U.S. Pat. Nos. 2,540,085, 2,597,876, 2,597,915, 2,399,083, etc.), sensitization with a group VIII metal ion (U.S. Pat. Nos. 2,448,060, 2,540,086, 2,566,245, 2,566,263, 2,598,079, etc.), sulfur sensitization (U.S. Pat. Nos. 1,574,944, 2,278,947, 2,440,206, 2,521,926, 3,021,215, 3,038,805, 2,410,689, 3,189,458, 3,415,649, 3,635,717, etc.), reduction sensitization (U.S. Pat. Nos. 2,518,698, 2,419,974, 2,983,610, *Research Disclosure,* Vol. 176 (December, 1978), RD-17643, item III, etc.), sensitization with thioether compounds (U.S. Pat. Nos. 2,521,926, 3,021,215, 3,038,805, 3,046,129, 3,046,132, 3,046,133, 3,046,134, 3,046,135, 3,057,724, 3,062,646, 3,165,552, 3,189,458, 3,192,046, 3,506,443, 3,671,260, 3,574,709, 3,625,697, 3,635,717, 4,198,240, etc.) or the combination thereof.

As specific chemical sensitizing agents, there are illustrated sulfur sensitizing agents (e.g., allylthiocarbamide, thiourea, sodium thiosulfate, thioether, cystine, etc.), noble metal sensitizing agents (e.g., potassium chloroaurate, aurous thiosulfate, potassium chloropalladate, etc.), and reduction sensitizers (e.g., tin chloride, phenylhydrazine, reductone, etc.).

In addition, the photographic emulsion may contain such sensitizers as a polyoxyethylene derivative (British Pat. No. 981,470, Japanese Patent Publication No. 6475/56, U.S. Pat. No. 2,716,062, etc.), a polyoxypropylene derivative, a quaternary ammonium group-containing derivative, etc.

To the photographic emulsion of the present invention may be added various compounds for the purpose of preventing reduction of sensitivity and formation of fog in the step of producing, or during storage or processing of, light-sensitive materials. As such compounds, many compounds have long been known such as many heterocyclic compounds including nitrobenzimidazole, ammonium chloroplatinate, 4-hydroxy-6-methyl-1,3,3a,7-tetraazaindene, and 1-phenyl-5-mercaptotetrazole, mercury-containing compounds, mercapto compounds, metal salts, etc. Some usable examples thereof are described in K. Mees, *The Theory of the Photographic Process* (3rd Ed., 1966), pp. 344–349, referring to original literature articles. Specific examples of the compounds are: thiazolium salts described in U.S. Pat. Nos. 2,131,038, 2,694,716, etc.; azaindenes described in U.S. Pat. Nos. 2,886,437 and 2,444,605; urazoles described in U.S. Pat. No. 3,287,135, etc.; sulfocatechols described in U.S. Pat. No. 3,236,652, etc.; oximes described in British Pat. No. 623,448, etc.; mercaptotetrazoles described in U.S. Pat. Nos. 2,403,927, 3,266,897, 3,397,987, etc.; nitron; nitroindazoles; polyvalent metal salts described in U.S. Pat. No. 2,839,405, etc.; thiuronium salts described in U.S. Pat. No. 3,220,839, etc.; and salts of palladium, platinum and gold described in U.S. Pat. Nos. 2,566,263, 2,597,915, etc.

In the silver halide photographic emulsion may be incorporated a developing agent such as a hydroquinone; a catechol; an aminophenol; a 3-pyrazolidone; ascorbic acid or its derivatives; a reductone; a phenylenediamine; or a combination of these developing agents. The developing agent may be incorporated in a silver halide emulsion layer and/or other photographic layer(s) (for example, a protective layer, an interlayer, a filter layer, an antihalation layer, a backing layer, etc.). The developing agent may be added by dissolving in a suitable solvent or as a dispersion described in U.S. Pat. No. 2,592,368 or French Pat. No. 1,505,778.

As development-accelerating agents, those compounds which are described in, for example, U.S. Pat. Nos. 3,288,612, 3,333,959, 3,345,175, 3,708,303, British Pat. No. 1,098,748, West German Pat. Nos. 1,141,531, 1,183,784, etc., can be used.

Emulsion-hardening processing can be conducted in a conventional manner. Examples of the hardening agents include: aldehyde type compounds such as formaldehyde and glutaraldehyde; ketone compounds such as diacetylcyclopentanedione; reactive halogen-containing compounds such as bis(2-chloroethylurea), 2-hydroxy-4,6-dichloro-1,3,5-triazine, and those described in U.S. Pat. Nos. 3,288,775, 2,732,303, British Pat. Nos. 974,723, 1,167,207, etc.; reactive olefin-containing compounds such as divinylsulfone, 5-acetyl-1,3-diacryloylhexahydro-1,3,5-triazine, and those described in U.S. Pat. Nos. 3,635,718, 3,232,763, British Pat. No. 994,869, etc.; N-methylol compounds such as N-hydroxymethylphthalimide and those described in U.S. Pat. Nos. 2,732,316, 2,586,168, etc.; isocyanates as described in U.S. Pat. No. 3,103,437; aziridine compounds as described in U.S. Pat. Nos. 3,017,280, 2,983,611, etc.; acid derivatives as described in U.S. Pat. Nos. 2,725,294, 2,725,295, etc.; carbodiimide compounds as described in U.S. Pat. No. 3,100,704, etc.; epoxy compounds as shown in U.S. Pat. No. 3,091,537, etc.; isoxazole compounds as shown in U.S. Pat. Nos. 3,321,313 and 3,543,292; halogenocarboxyaldehydes such as mucochloric acid; dioxane derivatives such as dihydroxydioxane and dichlorodioxane; and inorganic hardeners such as chromium alum, zirconium sulfate, etc. In place of these compounds, their precursors such as alkali metal bisulfite-aldehyde adducts, hydantoin methylol derivatives, and primary aliphatic nitroalcohols may be used as well.

Surfactants may be added, alone or in combination, to a photographic emulsion of the present invention. They are used as coating aids but, in some cases, for other purposes such as improvement of emulsion dispersion, improvement of photographic sensitization properties, antistatic purpose, prevention of adhesion, etc. The surfactants are categorized into: natural surfactants such as saponin; nonionic surfactants such as alkylene oxide derivatives, glycerin derivatives, glycidol derivatives, etc.; cationic surfactants such as higher alkylamines, quaternary ammonium salts, heterocyclic compounds (e.g., pyridine, etc.), phosphonium compounds, sulfonium compounds, etc.; anionic surfactants having an acidic group such as a carboxylic acid group, a sulfonic acid group, a phosphoric acid group, a sulfuric ester group or a phosphoric ester group; and amphoteric surfactants such as amino acids, aminosulfonic acids, aminoalcohol sulfuric or phosphoric esters, etc.

Some examples of these usable surfactants are described in patents such as U.S. Pat. Nos. 2,271,623, 2,240,472, 2,288,226, 2,739,891, 3,068,101, 3,158,484, 3,201,253, 3,210,191, 3,294,540, 3,415,649, 3,441,413, 3,442,654, 3,475,174, 3,545,974, German Pat. No. 1,942,665, British Pat. Nos. 1,077,317, 1,198,450, and such books as Ryohei Oda et al., *Synthesis and Application of Surfactants* (Maki Shoten (Japan), 1964), A. W. Perry, *Surface Active Agents* (Interscience Publication Inc., 1958), J. P. Sisley, *Encyclopedia of Surface Active Agents,* Vol. 2 (Chemical Publish Company, 1964), and the like.

To the silver halide photographic emulsion to be used in the present invention may be added, as a protective colloid, an acylated gelatin such as phthaloylated gelatin or malonoylated gelatin, a cellulose compound such as hydroxyethyl cellulose or carboxymethyl cellulose, soluble starch such as dextrin, or a hydrophilic polymer such as polyvinyl alcohol, polyvinyl pyrrolidone, polyacrylamide, or polystyrenesulfonic acid.

In the present invention, for the purpose of improving qualities of images, particularly dot images, condensates between a polyalkylene oxide compound such as a polymer comprising preferably at least 10 units of alkylene oxide having 2 to 4 carbon atoms (e.g., ethylene oxide, propylene-1,2-oxide, butylene-1,2-oxide, with ethylene oxide being preferable) and a compound having at least one active hydrogen atom such as water, aliphatic alcohol, aromatic alcohol, fatty acid, organic amine, hexitol derivative or the like, or a block copolymer of two or more, in kind, of polyalkylene oxides can be used. Specific usable examples of the polyalkylene oxide compounds include:

Polyalkylene glycols,
Polyalkylene glycol alkyl ethers,
Polyalkylene glycol aryl ethers,
Polyalkylene glycol alkylaryl ethers,
Polyalkylene glycol esters,
Polyalkylene glycol fatty acid amides,
Polyalkylene glycol amines,
Polyalkylene glycol block copolymers,
Polyalkylene glycol graft polymers, etc.

These must have a molecular weight of 600 or more.

The number of the polyalkylene oxide chains in the molecule is not limiltd to 1, and 2 or more chains may be present. With such compounds, each polyalkylene oxide chain may contain less than 10 alkylene oxide units, but the sum of the alkylene oxide units in the molecule must be at least 10. With compounds containing 2 or more polyalkylene oxide chains in the molecule, each polyalkylene oxide chain may contain the same alkylene oxide chain units or alkylene oxide units different from that of the other chain or chains. For example, one chain may comprise ethylene oxide units, and the other chain may comprise propylene oxide units. The polyalkylene oxide compounds to be used in the present invention preferably contain 14 to 100 alkylene oxide units.

Specific examples of polyalkylene oxide compounds which can be used in the present invention are illustrated below:

$HO(CH_2CH_2O)_{90}H$ (IV-1)
$C_4H_9O(CH_2CH_2O)_{15}H$ (IV-2)
$C_{12}H_{25}O(CH_2CH_2O)_{15}H$ (IV-3)
$C_{18}H_{37}O(CH_2CH_2O)_{15}H$ (IV-4)
$C_{18}H_{37}O(CH_2CH_2O)_{40}H$ (IV-5)
$C_8H_{17}CH{=}CHC_8H_{16}O(CH_2CH_2O)_{15}H$ (IV-6)

(IV-7)

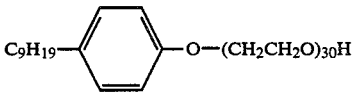

(IV-8)

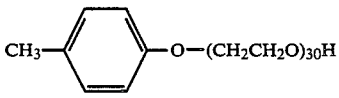

-continued (IV-9)

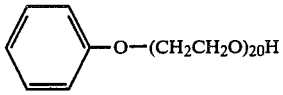

$C_{11}H_{23}COO(CH_2CH_2O)_{80}H$ (IV-10)
$C_{11}H_{23}COO(CH_2CH_2O)_{24}OCC_{11}H_{23}$ (IV-11)

(IV-12)

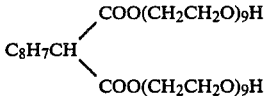

$C_{11}H_{23}CONH(CH_2CH_2O)_{15}H$ (IV-13)

(IV-14)

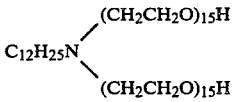

$C_{14}H_{29}N(CH_2)(CH_2CH_2O)_{24}H$ (IV-15)

(IV-16)

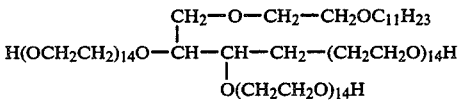

(IV-17)

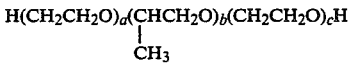

a + b + c = 50
b:a + c = 10:9

(IV-18)

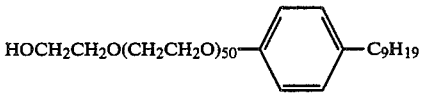

(IV-19)

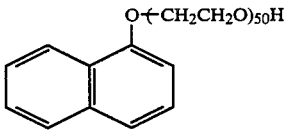

$HO(CH_2CH_2O)_a(CH_2CH_2CH_2CH_2O)_b(CH_2CH_2O)_cH$ (IV-20)
a + c = 30, b = 14

$HO(CH_2CH_2O)_a(CHCH_2O)_b(CH_2CH_2O)_cH$ (IV-21)

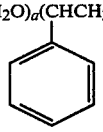

b = 8, a + c = 50

(IV-22)

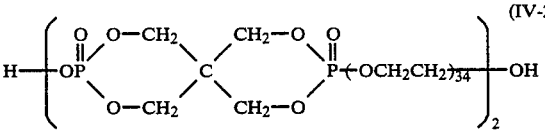

(IV-23)

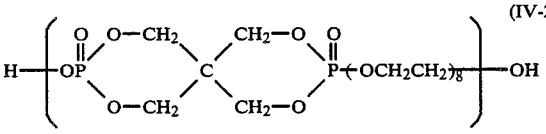

$HO(CH_2CH_2O)_{34}H$ (IV-24)

These and other polyalkylene oxide compounds described in Japanese Patent Application (OPI) Nos. 156423/75, 108130/77 and 3217/78 can be used. These polyalkylene oxide compounds may be used alone or in combination of two or more.

In adding the polyalkylene oxide compound to a silver halide emulsion, it can be added as an aqueous solution of a suitable concentration or as an organic solution in a water-miscible organic solvent having a low boiling point at an appropriate stage before coating, preferably after chemical ripening of the silver halide emulsion. In the present invention, the polyalkylene oxide compound is desirably used in an amount of $1\times10^{-5}$ mol to $1\times10^{-2}$ mol per mol of silver halide.

Also, for the purpose of improving dimensional stability of a photographic material, film properties, etc., a polymer latex comprising a homopolymer or copolymer of alkyl acrylate, alkyl methacrylate, acrylic acid, glycidyl acrylate or the like described in U.S. Pat. Nos. 3,411,911, 3,411,912, 3,142,568, 3,325,286, 3,547,650, Japanese Patent Publication No. 5331/70, etc., can be incorporated in the silver halide photographic emulsion.

The silver halide photographic emulsion may further contain an anti-fogging agent, a plasticizer, a fluorescent brightening agent, an air fog-preventing agent, a toning agent, etc.

The silver halide photographic emulsion of the present invention may contain color couplers such as a cyan coupler, a magenta coupler, and a yellow coupler and compounds capable of dispersing the couplers.

That is, it may contain compounds capable of forming color by oxidative coupling with an aromatic primary amine developing agent (for example, a phenylenediamine derivative or an aminophenol derivative) in color development processing. Of these couplers, non-diffusible couplers having a hydrophobic group called a ballast group are desirable. The couplers may be of either 4-equivalent type or 2-equivalent type with respect to silver ion. Colored couplers having a color-correcting effect or couplers capable of releasing a development inhibitor upon development (callide DIR couplers) may also be used.

In addition to DIR couplers, DIR coupling compounds capable of forming a colorless coupling reaction product and releasing a development inhibitor may also be incorporated.

The light-sensitive material of the present invention may be developed with a color developer containing a diffusible coupler to form a color image.

As irradiation-preventing dyes to be used depending upon end-use, there can be used those described in, for example, Japanese Patent Publication Nos. 20389/66, 3504/68, 13168/68, U.S. Pat. Nos. 2,697,037, 3,423,207, 2,865,752, British Pat. Nos. 1,030,392, 1,100,546, etc.

The present invention can be applied to sensitization of silver halide emulsions to be used for various color light-sensitive materials as well as sensitization of black-and-white photographic emulsions.

In addition to the emulsion layer of the present invention, another emulsion having sensitivity in other spectral regions may be further coated to form a so-called multilayered, multicolor light-sensitive material.

Exposure for obtaining a photographic image may be conducted in a conventional manner. That is, any of various known light sources emitting light rays including infrared rays such as natural light (sunlight), tungsten lamp, mercury lamp, xenon-arc lamp, carbon arc lamp, xenon flash lamp, cathode ray tube flying spot, light-emitting diode, laser light (for example, gas laser, dye laser, YAG laser, semiconductor laser, etc.), etc., may be used. Also, exposure may be effected by using light emitted from a fluorescent body excited with electron beams, X-rays, gamma-rays, $\alpha$-rays or the like. As to exposure time, an exposure time of 1/1,000 second to 1 second employed for an ordinary camera, an exposure time shorter than 1/1,000 second (for example, $1/10^4$ to $1/10^6$ second exposure using a xenon flash lamp or CRT), and an exposure time longer than 1 second may be employed. If necessary, spectral composition of light rays to be used for the exposure may be adjusted by using a color filter.

The silver halide photographic emulsion is coated on a support together with, if necessary, other photographic layers. That is, the emulsion may be coated on a support by various coating methods including a dip coating method, an air knife coating method, a curtain coating method, and an extrusion coating method using a hopper described in U.S. Pat. No. 2,681,294.

Two or more layers may be coated, if necessary, at the same time according to the methods described in U.S. Pat. Nos. 2,761,791, 3,508,947, 2,941,898, 3,526,528, etc.

As the support, flat substances which do not undergo serious dimensional change during processing are preferable. For example, there are included hard supports such as glass, metal, porcelain, etc., and flexible supports, which are selected depending upon the end-use. Typical flexible supports include a cellulose nitrate film, a cellulose acetate film, a cellulose acetate butyrate film, a cellulose acetate propionate film, a polystyrene film, a polyethylene terephthalate film, a polycarbonate film, a laminate thereof, a thin glass film, paper, etc., which are commonly used for photographic light-sensitive materials. Papers coated or laminated with baryta or $\alpha$-olefin polymer (particularly, polymers of $\alpha$-olefin having 2 to 10 carbon atoms, such as polyethylene, polypropylene, ethylene/butene copolymer, etc.) and plastic films whose surface has been made rough to improve intimate adhesive properties with other polymer substance and raise printability as described in Japanese Patent Publication No. 19068/72 can also provide good results.

As a suitable support, a transparent or opaque support is selected depending upon the end-use of the light-sensitive material. Also, with transparent supports, not only colorless, transparent ones but transparent supports colored by adding dyes or pigments can be used as well. This has heretofore been conducted with X-ray films and is described in J. SMPTE, Vol. 67, p. 296 (1958), etc.

Opaque supports include essentially opaque ones like paper and, in addition, those prepared by adding dyes or pigments like titanium oxide to a transparent film, plastic films having been surface-treated according to the process described in Japanese Patent Publication No. 19068/72, papers or plastic films to which carbon black, dye or the like has been added to completely cut light, and the like. Where adhesion force between the support and the photographic emulsion is insufficient, an adhesive layer which is adhesive to both the support and the photographic emulsion layer is provided as a subbing layer. Also, in order to better improve the adhesion properties, the surface of the support may be subjected to such preliminary treatment as corona discharge treatment, ultraviolet ray irradiation treatment, flame treatment, etc.

The light-sensitive material of the present invention can be photographically processed by any known processes. As processing solutions, known ones may be used. Processing temperature is selected usually between 18° C. and 50° C., but temperatures lower than 18° C. or higher than 50° C. may also be selected. Development processing for forming silver image (black-and-white photographic processing) or color photographic processing involving a development step for forming dye image may be applied to the light-sensitive material of the present invention depending upon the end-use.

The developing solution for effecting black-and-white photographic processing can contain known developing agents.

As the developing agents, dihydroxybenzenes (e.g., hydroquinone), 3-pyrazolidones (e.g., 1-phenyl-3-pyrazolidone), aminophenols (e.g., N-methyl-p-aminophenol), 1-phenyl-3-pyrazolines, ascorbic acid, and heterocyclic compounds wherein a 1,2,3,4-tetrahydroquinoline ring is fused with an indolenine ring described in U.S. Pat. No. 4,067,872, etc., can be used alone or in combination. Generally, the developing solution further contains known preservatives, alkali agents, pH buffers, anti-fogging agents, etc., and, if necessary, may further contain dissolving aids, toning agents, development accelerators, surfactants, defoaming agents, water-softening agents, hardeners, viscosity-imparting agents, etc.

So-called "lith-type" development processing may be applied to the photographic emulsion of the present invention. "Lith type" development processing means a development processing using usually a dihydroxybenzene as a developing agent and conducting development in an infectious manner at a low sulfite ion concentration for photographically reproducing line images or halftone dot images. (Detailed descriptions are given in Mason, *Photographic Processing Chemistry* (1966), pp. 163–165.)

As a fixing solution, those which have the same formulation as are ordinarily employed can be used. As a fixing agent, organic sulfur compounds which are known to function as fixing agents can be used as well as thiosulfates and thiocyanates. The fixing solution may contain a water-soluble aluminum salt as a hardener.

In forming dye images, ordinary processes can be applied. For example, there may be employed a negative-positive process (described in, for example, *Journal of the Society of Motion Picture and Television Engineers*, Vol. 61 (1953), pp. 667–701); a color reversal process of forming a negative silver image by developing with a developing solution containing a black-and-white developing agent, conducting at least one uniform exposure or other proper fogging processing, and subsequently conducting color development to thereby obtain a positive dye image; a silver dye-bleaching process of forming a silver image by developing a dye-containing photographic emulsion layer after imagewise exposure to thereby form a silver image, and bleaching the dye using the silver image as a bleaching catalyst; and the like.

The color developing agents are described in detail in, for example, L. F. A. Mason, *Photographic Processing Chemistry* (Focal Press, London, 1966), pp. 226–229, etc. They may be used in combination with 3-pyrazolidones.

To the color developer may be added, if necessary, various additives.

After development processing, the silver halide photographic emulsion is fixed in a conventional manner and, in some cases, subjected to bleaching. The bleaching may be conducted simultaneously with, or separately from, the fixing processing. Where bleaching and fixing are conducted simultaneously, the light-sensitive material is processed in a bleach-fixing bath containing both a bleaching agent and a fixing agent.

The present invention can be applied to a light-sensitive material containing silver in an amount as low as a fraction to 1/100 of that of ordinary light-sensitive materials.

The present invention will now be described in more detail by referring to non-limiting examples of the preferred embodiments of the present invention.

EXAMPLE 1

Silver halide grains were precipitated by a double jet method, physically ripened, desalted and chemically ripened to obtain a silver bromoiodide emulsion (containing 2 mol% iodide). The grains had a mean diameter of 0.5μ. 0.6 mol silver halide was contained per kg of the emulsion.

1 kg portions of this emulsion were weighed and, after heating to 40° C. to dissolve, each sensitizing dye included in the general formula (I) and each compound included in the general formula (II) were added thereto as methanol solutions as given in Table 1, followed by mixing and stirring. Then, 30 ml of a 1.0 wt% aqueous solution of 1-hydroxy-3,5-dichlorotriazine sodium salt was added thereto, then 45 ml of a 1.0 wt% aqueous solution of sodium dodecylbenzenesulfonate was added thereto, followed by stirring the resulting mixture. Each of the thus completed emulsions was coated on a cellulose triacetate film base in a dry thickness of 5μ, then dried to obtain light-sensitive material samples. Each of the film samples was exposed through an optical wedge using a sensitometer containing a light source of 2,854° K. in color temperature fitted with a dark red filter (SC-60) made by Fuji Photo Film Co., Ltd. After the exposure, they were developed at 20° C. for 3 minutes using a developer of the following formulation, processed in a stopping bath and a fixing bath, then washed with water to obtain strips with predetermined black-and-white image. Density of each image was measured using a model P densitometer made by Fuji Photo Film Co., Ltd. to obtain sensitivity and fog data. The sensitivity was relatively determined taking an optical density of (fog+0.3) as a standard point.

| Formulation of Developer: | |
|---|---|
| Water | 500 ml |
| N—Methyl-p-aminophenol | 2.2 g |
| Anhydrous Sodium Sulfite | 96.0 g |
| Hydroquinone | 8.8 g |
| Sodium Carbonate Monohydrate | 56.0 g |
| Potassium Bromide | 5.0 g |
| Water to make | 1 liter |

The results thus obtained are tabulated in Table 1 as relative values. The results show that the combination of the dye and the compound of the present invention provided excellent light-sensitive materials having higher sensitivity and forming less fog than the light-sensitive materials containing dye alone and the comparative samples.

TABLE 1

| No. | Sensitizing Dye (I) and Amount Used ($\times 10^{-5}$ mol/kg emulsion) | Compound (II) and Amount Used (mg/kg emulsion) | Relative Sensitivity | Fog |
|---|---|---|---|---|
| 1 | (I-1) 3 | — | 100 (standard) | 0.07 |
| 2 | (I-1) 3 | (II-1) 90 | 115 | 0.07 |
| 3 | (I-1) 3 | (II-1) 180 | 126 | 0.07 |
| 4 | (I-1) 3 | (II-1) 270 | 132 | 0.06 |
| 5 | (I-1) 3 | (II-4) 90 | 117 | 0.07 |
| 6 | (I-1) 3 | (II-4) 180 | 129 | 0.06 |
| 7 | (I-1) 3 | (II-4) 270 | 135 | 0.06 |
| 8 | (I-1) 3 | (II-5) 90 | 112 | 0.07 |
| 9 | (I-1) 3 | (II-5) 180 | 123 | 0.06 |
| 10 | (I-1) 3 | (II-5) 270 | 129 | 0.06 |
| 11* | (I-1) 3 | Compound A** 90 | 89 | 0.07 |
| 12* | (I-1) 3 | Compound A** 180 | 79 | 0.07 |
| 13* | (I-1) 3 | Compound A** 270 | 72 | 0.07 |
| 14 | (I-4) 3 | — | 100 (standard) | 0.07 |
| 15 | (I-4) 3 | (II-11) 90 | 107 | 0.07 |
| 16 | (I-4) 3 | (II-11) 180 | 115 | 0.07 |
| 17 | (I-4) 3 | (II-11) 270 | 120 | 0.07 |
| 18 | (I-4) 3 | (II-16) 90 | 110 | 0.07 |
| 19 | (I-4) 3 | (II-16) 180 | 120 | 0.06 |
| 20 | (I-4) 3 | (II-16) 270 | 126 | 0.06 |
| 21 | (I-4) 3 | (II-9) 90 | 112 | 0.06 |
| 22 | (I-4) 3 | (II-9) 180 | 129 | 0.06 |
| 23 | (I-4) 3 | (II-9) 270 | 132 | 0.06 |
| 24* | (I-4) 3 | Compound A** 90 | 87 | 0.07 |
| 25* | (I-4) 3 | Compound A** 180 | 78 | 0.07 |
| 26* | (I-4) 3 | Compound A** 270 | 72 | 0.07 |
| 27 | (I-2) 3 | — | 100 (standard) | 0.07 |
| 28 | (I-2) 6 | — | 91 | 0.07 |
| 29 | (I-2) 3 | (II-2) 180 | 117 | 0.06 |
| 30 | (I-2) 6 | (II-2) 180 | 120 | 0.06 |
| 31 | (I-7) 3 | — | 100 (standard) | 0.07 |
| 32 | (I-7) 6 | — | 91 | 0.07 |
| 33 | (I-7) 3 | (II-2) 180 | 123 | 0.06 |
| 34 | (I-7) 6 | (II-2) 180 | 126 | 0.06 |
| 35 | (I-11) 3 | — | 100 (standard) | 0.07 |
| 36 | (I-11) 6 | — | 89 | 0.07 |
| 37 | (I-11) 3 | (II-2) 180 | 126 | 0.06 |
| 38 | (I-11) 6 | (II-2) 180 | 123 | 0.06 |
| 39 | (I-12) 3 | — | 100 (standard) | 0.07 |
| 40 | (I-11) 6 | — | 87 | 0.07 |
| 41 | (I-12) 3 | (II-2) 180 | 112 | 0.06 |
| 42 | (I-12) 6 | (II-2) 180 | 115 | 0.06 |

*Comparative Example

**Structure of Comparative Compound A:

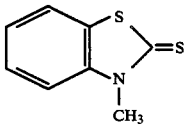

COMPARATIVE EXAMPLE

Film samples prepared in the same manner as in Example 1 except for changing the combination of the dye and the compound of general formula (II) as shown in Table 2 were exposed and developed in the same manner as in Example 1. The results thus obtained are shown in Table 2.

TABLE 2

| No. | Comparative Sensitizing Dye and Amount Used ($\times 10^{-5}$ mol/kg emulsion) | Compound (II) and Amount Used (mg/kg emulsion) | Relative Sensitivity | Fog |
|---|---|---|---|---|
| 1 | Dye A*1 3 | — | 100 (standard) | 0.07 |
| 2 | Dye A*1 3 | (II-1) 90 | 98 | 0.07 |
| 3 | Dye A*1 3 | (II-1) 180 | 95 | 0.07 |
| 4 | Dye B*2 3 | — | 100 (standard) | 0.07 |
| 5 | Dye B*2 3 | (II-1) 90 | 95 | 0.07 |
| 6 | Dye B*2 3 | (II-1) 180 | 93 | 0.07 |

*1Structure of Comparative Dye A:

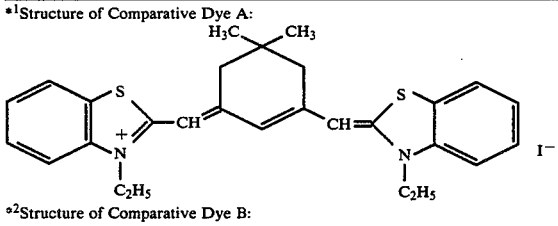

*2Structure of Comparative Dye B:

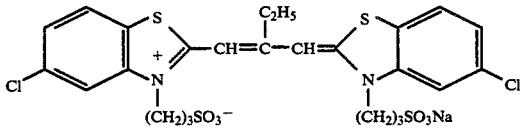

It is seen from Table 2 that no supersensitizing effect can be obtained by combining the compound of the present invention represented by the general formula (II) with the visible region-sensitizing dye.

EXAMPLE 2

An aqueous solution of 1 kg of $AgNO_3$ and an aqueous solution of 210 g of KBr and 290 g of NaCl were simultaneously added at a constant rate in 30 minutes to an aqueous solution containing 70 g of gelatin. After removal of soluble salts, gelatin was added thereto, followed by chemical ripening to obtain a silver chlorobromide emulsion (particle size: 0.27$\mu$; Br: 30 mol%). To this emulsion was added 4-hydroxy-6-methyl-1,3,3a,7-tetraazaindene as a stabilizer.

Each sensitizing dye included in the general formula (I) and each compound included in the general formula (II) (and each compound of the general formula (III)) were added to the emulsion as shown in Tables 3 and 4. Then, 1-hydroxy-3,5-dichlorotriazine sodium salt (hardener) and sodium dodecylbenzenesulfonate (coating aid) were added thereto, and each of the resulting emulsions was coated on a polyethylene terephthalate film in a silver amount of 4.5 g/m$^2$.

Each of the thus prepared film samples was exposed through an optical wedge through a dark red filter SC-72 (made by Fuji Photo Film Co., Ltd.), then developed at 20°C. for 4 minutes using the following developer, processed in a stopping bath and a fixing bath, then washed with water. Density of each sample was measured using a model P densitometer made by Fuji Photo Film Co., Ltd. to obtain sensitivity and fog data. The sensitivity was relatively determined taking an optical density of (fog+0.3) as a standard point.

| Formulation of Developer: | |
|---|---|
| Metol | 0.31 g |
| Anhydrous Sodium Sulfite | 39.6 g |
| Hydroquinone | 6.0 g |
| Anhydrous Sodium Carbonate | 18.7 g |
| Potassium Bromide | 0.86 g |

-continued

| Formulation of Developer: | |
|---|---|
| Citric Acid | 0.68 g |
| Potassium Metabisulfite | 1.5 g |
| Water to make | 1 liter |

TABLE 3

| No. | Sensitizing Dye (I) and Amount Used ($\times 10^{-5}$ mol/kg emulsion) | | Compound (II) and Compound (III) and Amounts Used (mg/kg emulsion) | | | | Relative Sensitivity | Fog |
|---|---|---|---|---|---|---|---|---|
| 1 | (I-5) | 6 | — | | — | | 100 (standard) | 0.05 |
| 2 | " | 6 | (II-3) | 90 | — | | 129 | 0.05 |
| 3 | " | 6 | " | 180 | — | | 138 | 0.04 |
| 4 | " | 6 | " | 270 | — | | 151 | 0.04 |
| 5 | " | 6 | — | | (III-1) | 200 | 501 | 0.05 |
| 6 | " | 6 | (II-3) | 90 | " | 200 | 646 | 0.05 |
| 7 | " | 6 | " | 180 | " | 200 | 708 | 0.04 |
| 8 | " | 6 | " | 270 | " | 200 | 776 | 0.04 |
| 9 | " | 6 | (II-6) | 90 | — | | 123 | 0.05 |
| 10 | " | 6 | " | 180 | — | | 135 | 0.05 |
| 11 | " | 6 | " | 270 | — | | 148 | 0.04 |
| 12 | " | 6 | " | 90 | (III-1) | 200 | 631 | 0.05 |
| 13 | " | 6 | " | 180 | " | 200 | 692 | 0.04 |
| 14 | " | 6 | " | 270 | " | 200 | 759 | 0.04 |

It is seen from the results given in Table 3 that the combination of the dye and the compound of the present invention provided higher sensitivity and caused less fog than independent use of the dye. In addition, addition of the Compound (III) to the combination of the present invention provided much higher sensitivity.

EXAMPLE 3

Film samples prepared in the same manner as in Example 2 except for changing the compound to that shown in Table 4 and stored for 3 days at high temperature and high humidity (50° C., 75% RH) and the same samples stored for 3 days at room temperature (20° C., 60% RH) (for comparison) were subjected to the same exposure, development, stopping, fixing, washing with water, and drying as in Example 2.

The results thus obtained are tabulated in Table 4.

TABLE 4

| No. | Sensitizing Dye (I) and Amount Used ($\times 10^{-5}$ mol/kg emulsion) | | Compound (II) and Compound (III) and Amounts Used (mg/kg emulsion) | | | | Stored at Room Temperature (20° C., 60% RH) Relative Sensitivity | Fog | Stored at High Temperature and High Humidity (50° C., 75% RH) Relative Sensitivity | Fog |
|---|---|---|---|---|---|---|---|---|---|---|
| 1 | (I-6) | 6 | — | | — | | 100 (standard) | 0.05 | 50 | 0.07 |
| 2 | " | 6 | (II-3) | 90 | — | | 145 | 0.05 | 138 | 0.05 |
| 3 | " | 6 | " | 180 | — | | 155 | 0.04 | 155 | 0.04 |
| 4 | " | 6 | — | | (III-3) | 200 | 525 | 0.05 | 417 | 0.05 |
| 5 | " | 6 | (II-3) | 90 | " | 200 | 794 | 0.05 | 794 | 0.05 |
| 6 | " | 6 | " | 180 | " | 200 | 851 | 0.04 | 851 | 0.04 |
| 7 | (I-9) | 6 | — | | — | | 100 (standard) | 0.05 | 42 | 0.07 |
| 8 | " | 6 | (II-7) | 90 | — | | 135 | 0.05 | 129 | 0.05 |
| 9 | " | 6 | " | 180 | — | | 141 | 0.05 | 138 | 0.05 |
| 10 | " | 6 | — | | (III-3) | 200 | 490 | 0.05 | 389 | 0.05 |
| 11 | " | 6 | (II-7) | 90 | " | 200 | 676 | 0.05 | 676 | 0.05 |
| 12 | " | 6 | " | 180 | " | 200 | 741 | 0.05 | 741 | 0.05 |

It is seen from Table 4 that the combination of the dye and the compound of the present invention provided higher sensitivity than the independent use of the dye and provided excellent storage stability. Table 4 also shows that this effect can be obtained when the compound of the general formula (III) is further combined with the combination of the present invention.

EXAMPLE 4

A silver chlorobromoiodide emulsion (grain size: 0.25μ; bromide: 25 mol%; iodide: 0.1 mol%) was prepared by gold sensitizing and sulfur sensitizing in the same manner as in Example 2.

Upon preparation of silver halide grains, rhodium was added in an amount of $5\times10^{-7}$ mol/mol of silver.

4-Hydroxy-6-methyl-1,3,3a,7-tetraazaindene was added to this emulsion as a stabilizer. A sensitizing dye shown in Table 5 and included in the general formula (I) and a compound included in the general formula (II) were added thereto and Compound (III-5) was further added to the emulsion in an amount of 220 mg per kg of the emulsion. Part of the emulsion was kept at 40° C. for 1 hour under stirring, and the rest for 15 hours under the same conditions. A hardener was added to each emulsion, then the resulting emulsions were coated, respectively, on polyethylene terephthalate film in a silver amount of 4.0 g/m$^2$. These film samples were exposed and developed in the same manner as in Example 2, then stopped, fixed and dried to measure density. The standard point for measuring the sensitivity was a point of (fog+0.5).

TABLE 5

| No. | Sensitizing Dye (I) and Amount Used ($\times 10^{-5}$ mol/kg emulsion) | | Compound (II) and Amount Used (mg/kg emulsion) | | Storage Time of Emulsion Solution: 1 Hour Relative Sensitivity | 1 Hour Fog | 15 Hours Relative Sensitivity | 15 Hours Fog |
|---|---|---|---|---|---|---|---|---|
| 1 | (I-1) | 8 | — | | 100 | 0.05 | 56 | 0.07 |
| 2 | " | 8 | (II-8) | 100 | 138 | 0.05 | 132 | 0.05 |
| 3 | " | 8 | " | 200 | 151 | 0.05 | 148 | 0.05 |
| 4 | (I-6) | 8 | — | | 100 (standard) | 0.05 | 51 | 0.07 |
| 5 | " | 8 | (II-9) | 100 | 129 | 0.05 | 123 | 0.05 |
| 6 | " | 8 | " | 200 | 145 | 0.04 | 141 | 0.04 |
| 7 | (I-9) | 8 | — | | 100 (standard) | 0.05 | 48 | 0.07 |
| 8 | " | 8 | (II-17) | 100 | 126 | 0.05 | 120 | 0.05 |
| 9 | " | 8 | " | 200 | 132 | 0.05 | 126 | 0.04 |

It is seen from these results that the independent use of the dye caused serious desensitization and an increased fog when the emulsion was stored in a solution state, whereas the combination of the dye and the compound of the present invention caused less desensitization and did not undergo increased fogging.

EXAMPLE 5

A silver halide emulsion comprising 80 mol% of silver chloride, 19.7 mol% of silver bromide, and 0.3 mol% of silver iodide was prepared by gold sensitization and sulfur sensitization. The silver halide grains had a mean particle size of 0.35$\mu$.

625 g portions of the emulsion were weighed, and Sensitizing Dye (I) and Compound (II) were added to each portion as shown in Table 6. Further, 0.25 g, per mol of AgX, of Compound (III-3), 0.3 g, per mol of AgX, of 4-hydroxy-6-methyl-1,3,3a,7-tetraazaindene (stabilizer), 0.75 g, per mol of AgX, of a polyalkylene oxide Compound (IV-21), 2 g, per mol of AgX, of sodium dodecylbenzenesulfonate (surfactant), 0.8 g, per mol of AgX, of mucochloric acid (hardener), and 50 g, per mol of AgX, of a polymer latex described in Japanese Patent Publication No. 5331/70 were added successively to each portion, then coated on a polyethylene terephthalate film base to obtain photographic light-sensitive materials.

Each of these samples was brought into contact with a gray contact screen for negative (made by Dainippon Screen Mfg. Co., Ltd.; 150 L/inch) and exposed using a semiconductor laser (made by Mitsubishi Electric Corp.; TP:ML-4001) through a step wedge of 0.1 (log E) in step difference according to the method described in Japanese Patent Application (OPI) No. 151933/82.

After exposure, each sample was developed at 27° C. for 100 seconds in an automatic developing machine. The results thus obtained are tabulated in Table 6. Additionally, sensitivity was a relative value determined from a reciprocal of an exposure amount necessary for obtaining 50% halftone dots.

TABLE 6

| No. | Sensitizing Dye (I) and Amount Used ($\times 10^{-5}$ mol/kg emulsion) | | Compound (II) and Amount Used (mg/kg emulsion) | | Relative Sensitivity | Fog | Quality of Halftone Dots |
|---|---|---|---|---|---|---|---|
| 1 (Comparison) | (I-6) | 3.5 | — | | 100 (standard) | 0.05 | B |
| 2 (Comparison) | " | 7.0 | — | | 105 | 0.05 | B |
| 3 (Invention) | " | 3.5 | (II-2) | 220 | 138 | 0.04 | A |
| 4 (Invention) | " | 7.0 | " | 220 | 141 | 0.04 | A |
| 5 (Invention) | " | 3.5 | (II-3) | 220 | 145 | 0.04 | A |
| 6 (Invention) | " | 7.0 | " | 220 | 155 | 0.04 | A |
| 7 (Comparison) | " | 3.5 | Compound B* | 220 | 105 | 0.05 | B |
| 8 (Comparison) | " | 7.0 | " | 220 | 107 | 0.05 | B |

*Compound B: 2-Mercapto-5-(p-chlorophenylaminosulfon)benzothiazole (compound described in Japanese Patent Publication No. 22883/68 = U.S. Pat. No. 3,457,078)
Halftone dot quality graded A means an extremely high quality with absolutely no fringes, and B means a somewhat deteriorated quality with some fringes.

As is clear from Table 6, the combination of the dye and the compound of the present invention provided light-sensitive materials having higher sensitivity, less fog, and better halftone dot quality than the comparative samples (Nos. 1 and 2) using the dye alone and the samples using compounds outside the scope of the present invention (Nos. 7 and 8).

While the invention has been described in detail and with reference to specific embodiments thereof, it will be apparent to one skilled in the art that various changes and modifications can be made therein without departing from the spirit and scope thereof.

What is claimed is:

1. A method of supersensitizing a silver halide photographic light-sensitive material, comprising:

supersensitizing a silver halide light-sensitive material having at least one silver halide photographic emulsion layer in said silver halide photographic light-sensitive material by incorporating in said silver halide photographic light-sensitive material:

(1) at least one infrared-sensitizing dye represented by the following general formula (I):

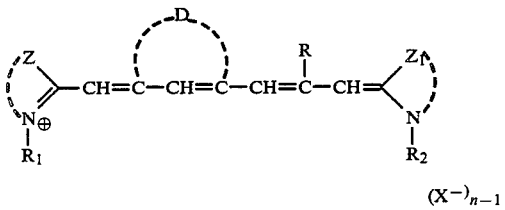

(I)

wherein $R_1$ and $R_2$, which may be the same or different, each represents an alkyl group or a substituted alkyl group, R represents a hydrogen atom, a lower alkyl group, a phenyl group or benzyl group, D represents non-metallic atoms necessary for forming a 6-membered ring containing three methylene units, Z and $Z_1$ each represents non-metallic atoms necessary for completing a 5- or 6-membered, nitrogen containing heterocyclic ring, X represents an acid anion, and n represents 1 or 2; and (2) at least one compound represented by the following general formula (II):

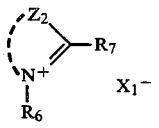

(II)

wherein $Z_2$ represents non-metallic atoms necessary for completing a 5- or 6-membered, nitrogen-containing heterocyclic ring, $R_6$ represents a hydrogen atom, an alkyl group or an alkenyl group, $R_7$ represents a hydrogen atom or a lower alkyl group; and $X_1$ represents an acid anion;

provided that when the general formula (I) represents a betaine compound n is 1.

2. A method as claimed in claim 1, wherein said silver halide photographic emulsion further contains at least one compound represented by the following general formula (III):

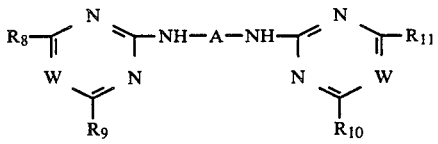

(III)

wherein A represents a divalent aromatic residue, $R_8$, $R_9$, $R_{10}$, and $R_{11}$ each represents a hydrogen atom, a hydroxy group, an alkyl group, an alkoxy group, an aryloxy group, a halogen atom, a heterocyclic ring nucleus, a heterocyclythio group, an arylthio group, an amino group, a substituted or unsubstituted alkylamino group, a substituted or unsubstituted alkylamino group, a substituted or unsubstituted aralkylamino group, an aryl group, or a mercapto group, provided that at least one of A, $R_8$, $R_9$, and $R_{10}$ and $R_{11}$ possess a sulfo group, and W represents —CH= or —N=.

3. A method as claimed in claim 1, wherein said silver halide photographic emulsion has a halide composition of AgClBr or AgClBrI containing 2 mol% or less of AgI.

4. A method as claimed in claim 1, wherein Z and $Z_1$ in the general formula (I) each represents non-metallic atoms necessary for completing a benzothiazole nucleus, a naphthothiazole nucleus; a naphtoxazole nucleus or a benzoxazole nucleus.

5. A method as claimed in claim 1, wherein $Z_2$ in the general formula (II) represents non-metallic atoms necessary for completing thiazoliums, oxazoliums, imidazoliums or selenazoliums.

6. A method as claimed in claim 5, wherein $Z_2$ is the general formula (II) represents non-metallic atoms necessary for completing benzothiazolium or napthothiazolium, each of which may be substituted or unsubstituted.

7. A method as claimed in claim 2, wherein W in the general formula (III) represents —CH=.

8. A method as claimed in claim 1, wherein the infrared-sensitizing dye represented by the general formula (I) is present in an amount of $5\times10^{-7}$ mol to $5\times10^{-3}$ mol per mol of silver halide.

9. A method as claimed in claim 1, wherein the compound represented by the general formula (II) is present in an amount of about 0.01 g to about 5 g/mol of silver halide.

10. A method as claimed in claim 1, wherein the ratio by weight of the infrared-sensitizing dye of the general formula (I) to the amount of the compound represented by the general formula (II) is 1/1 to 1/300.

11. A method as claimed in claim 2, wherein the compound represented by the general formula (III) is present in an amount of about 0.01 g to about 5 g/mol of silver halide.

12. A method as claimed in claim 2, wherein the ratio by weight of the infrared-sensitizing dye represented by the general formula (I) to the compound represented by the general formula (III) is in the range of from 1/1 to 1/100.

* * * * *